US010907801B1

(12) United States Patent
Zheng

(10) Patent No.: US 10,907,801 B1
(45) Date of Patent: Feb. 2, 2021

(54) LAMP CAPABLE OF EXPANDING ILLUMINATION RANGE

(71) Applicant: FUJIAN OUMEIDA ELECTRIC MACHINE CO., LTD., Fuan (CN)

(72) Inventor: YaoFu Zheng, Fuan (CN)

(73) Assignee: FUJIAN OUMEIDA ELECTRIC MACHINE CO., LTD., Fujian Province (CN)

( * ) Notice: Subject to any disclaimer, the term of this patent is extended or adjusted under 35 U.S.C. 154(b) by 0 days.

(21) Appl. No.: 16/567,522

(22) Filed: Sep. 11, 2019

(51) Int. Cl.

| | |
|---|---|
| ***F21V 21/00*** | (2006.01) |
| ***F21V 15/01*** | (2006.01) |
| ***F21V 29/74*** | (2015.01) |
| ***F21S 8/02*** | (2006.01) |
| ***F21V 1/10*** | (2006.01) |
| ***F21V 7/00*** | (2006.01) |
| ***F21V 17/12*** | (2006.01) |

(52) U.S. Cl.
CPC ..... *F21V 15/01* (2013.01); *F21S 8/026* (2013.01); *F21V 1/10* (2013.01); *F21V 7/0008* (2013.01); *F21V 17/12* (2013.01); *F21V 29/74* (2015.01)

(58) Field of Classification Search
CPC . F21V 15/01; F21V 29/74; F21V 1/10; F21V 7/0008; F21V 17/12; F21S 8/026
USPC ..... 362/362, 147, 148, 150, 364, 365, 366
See application file for complete search history.

(56) References Cited

U.S. PATENT DOCUMENTS

| | | | | |
|---|---|---|---|---|
| 8,641,243 | B1 * | 2/2014 | Rashidi | F21S 8/02 257/712 |
| 2017/0184285 | A1 * | 6/2017 | Visser | F21V 21/047 |
| 2017/0261164 | A1 * | 9/2017 | Ogata | H04B 45/10 |
| 2018/0356049 | A1 * | 12/2018 | Goelz | F21V 7/0025 |
| 2019/0162388 | A1 * | 5/2019 | Franck | F21S 8/026 |
| 2019/0254139 | A1 * | 8/2019 | Van Winkle | F21V 23/04 |
| 2019/0285234 | A1 * | 9/2019 | Tang | F21V 7/041 |
| 2019/0360666 | A1 * | 11/2019 | Bowen | F21V 17/12 |

* cited by examiner

*Primary Examiner* — Laura K Tso
(74) *Attorney, Agent, or Firm* — Alan D. Kamrath; Karin L. Williams; Mayer & Williams PC

(57) ABSTRACT

A lamp capable of expanding illumination range includes a lighting and cooling module, a reflective cup, a lampshade, a diffuser plate and a wash wall cup. The reflective cup and lampshade are connected to the lighting and cooling module; the lampshade surrounds the reflective cup; the diffuser plate is divided into an oblique circular arc plate and a riser; the circular arc plate has rule gratings formed by convex and concave embossed marks. A front arc wall is built on a side of the wash wall cup, and a rear arc wall is built on the other side. An inlay seam is formed between the front and rear arc walls; the circular arc plate is mounted onto the front arc wall; edges of the riser are plugged into the inlay seam; and the wash wall cup is plugged from the bottom of the lampshade to form the lamp.

6 Claims, 7 Drawing Sheets

LAMP CAPABLE OF EXPANDING ILLUMINATION RANGE

BACKGROUND OF THE INVENTION

Field of the Invention

The present disclosure relates to a lamp capable of expanding its illumination range, and more particularly to the lamp capable of refracting and diffusing light sufficiently to provide a thorough wall washing effect and expand the illumination range of the lamp.

Description of the Related Art

At present, a conventional lamp is mainly comprised of a lighting and cooling module and a lampshade, wherein the lighting and cooling module is further comprised of a cooling element and a lighting element, and a groove is formed at the bottom of the cooling element and provided for receiving the lighting element therein, and the top of the lampshade is screwed and coupled to the bottom of the cooling element so as to wrap the lighting element into the lampshade, and the light emitted from the lighting element is guided by the lampshade and projected in a predetermined direction.

However, the light of the conventional lamp is projected in a fixed angle, so that the range of the illumination area is also fixed. If a larger illumination range is required for the suppose of outlining the contour of a large building, serving as an interior design greening the landscape, and being used in the areas such as medical treatment, cultural and art products, restaurants, night clubs, bars, and building decoration. In these applications, it is necessary to add more sets of lamps, while providing projection to different areas in order to meet the requirements. However, the equipment and construction costs, and the electric bill for the illumination will be increased significantly. In view of these drawbacks, the discloser of this disclosure conducted extensive research and experiment, and finally developed a lamp capable of expanding its illumination range in accordance with this disclosure to overcome the drawbacks of the prior art.

SUMMARY OF THE INVENTION

Therefore, it is a primary objective of the present invention to provide a lamp capable of refracting and diffusing the light sufficiently as well as providing a thorough wall washing effect to achieve the effect of expanding the illumination range of the lamp.

To achieve the above mentioned objective, this disclosure discloses a lamp capable of expanding the illumination range, comprising a lighting and cooling module and further comprised of a cooling element and a lighting element, and a plurality of fins being formed at an upper section of the cooling element, and a base being formed at the bottom of the cooling element, and a grooved being inwardly and concavely formed at the bottom of the base, and the lighting element being supported by a support and attached onto an inner top surface of the groove; and the support having a large through hole formed at the center of the support, and a positioning slot formed at the top of the support for accommodating and positioning the lighting element, and the light emitted from the lighting element being diffused downwardly through the large through hole, and the bottom surface of the support having a flange with a height and formed at the periphery of the large through hole; a reflective cup, having a top and a bottom, both being hollow, and the top having a micro shield wall extending inwardly, and the reflective cup being supported by passing through the flange at the bottom of the support from the micro shield wall; and the inner wall of the reflective cup being designed as a polyhedron for completely refracting the light diffused by the lighting element; a lampshade, having a top and a bottom, both being hollow, and the top having a shield wall extending inwardly, and the lampshade being supported by connecting the shield wall and the base bottom surface to enclose the reflective cup and drooping from the bottom of the lighting and cooling module, and a positioning slot being formed at an inner edge of the bottom of the lampshade; a diffuser plate, being a translucent plate, and further divided into an oblique circular arc plate and a vertical riser, and the bottom of the circular arc plate having a plurality of ruled grating formed by convex and concave embossed marks, and each of the edges on both sides of the circular arc plate having a micro snap slot; and a wash wall cup, having an outwardly expanded micro shield wall disposed at the bottom thereof, a front arc wall standing upwardly and laterally with an inwardly tilted curve, and the front arc wall being higher than the front end, and extending downwardly towards both sides to a specific height, and a rear arc wall standing on the other side and being further divided into a rear oblique arc wall disposed at the bottom of the rear arc wall and a rear vertical arc wall disposed at the top of the rear arc wall, and both sides of the rear vertical arc wall dropping with a curvature and both sides of the rear oblique arc wall continuing to drop until their position being next to both sides of the front arc wall, so as to form an inlay seam, and a hollow top surface being formed and enclosed by the front arc wall and the rear arc wall jointly; a space enclosed by the front arc wall having an opening facing downward, and a space enclosed by the rear arc wall having a shielding wall facing downward, and each top edge on both sides of the front arc wall having a micro snap bump, and the height and position of the snap bump corresponding to those of the micro snap slot formed on both sides of edges of the circular arc plate; the wash wall cup having a plurality of engagement columns formed at several positions of the periphery, and each locking the upper part of an elastic plate, and the lower section of the elastic plate bending outwardly and having an elasticity; the circular arc plate of the diffuser plate being installed at the top edge of the front arc wall, and two micro snap slots clamping the corresponding micro snap bumps respectively, and both side edges of the riser of the diffuser plate being plugged into the inlay seam, and then the wash wall cup being pushed upwardly into the hollow from the bottom of the lampshade, and then the lower section of the elastic plate at the periphery of the wash wall cup being pressed to retract along the inner wall of the lampshade to abut the inner wall of the lampshade until the micro shield wall at the bottom of the wash wall cup is pressed into the positioning slot at the inner edge of the bottom of the lampshade bottom inner edge.

According to the above mentioned lamp capable of expanding the illumination range, each of both sides of the support has a penetrating hole, so that a screw can be passed through the penetrating hole, and the support and the lighting element are secured to the inner top surface of the groove.

According to the above mentioned lamp capable of expanding the illumination range, the support has a plurality of positioning plates protruding outwardly from the lower edge of the flange lower, and the micro shield wall of the reflective cup has a plurality of positioning slots formed thereon, so that when the micro shield wall passes through the flange of the support, the positioning slot of the micro shield wall also passes through the positioning plate of the support, and then the reflective cup is rotated to an angle, so that the micro shield wall next to the positioning slot will be supported when entering into a position between the bottom surface of the support and the positioning plate.

According to the above mentioned lamp capable of expanding the illumination range, the base bottom surface has a plurality of through slots formed on a circumferential surface thereof, and each through slot is provided for passing a screw from bottom to top through an elastic member, and then passing through the through slot, and a nut is screwed to the top thereof; several parts of the shield wall of the lampshade have a wide-narrow slot, and when the shield wall of the lampshade approaches the base, a wide hole of the wide-narrow slot of the shield wall is plugged with a head of the screw, and the lampshade is rotated to move a narrow slot of the wide-narrow slot to the head of each screw, such that the narrow slot of the wide-narrow slot is clamped by the head of the screw and the bottom of the base.

According to the above mentioned lamp capable of expanding the illumination range, the inner top surface of the groove is securable with a guard frame, which is a frame wall with a height, whose interior is a plane, and has a large through hole formed at the center, and a plurality of penetrating holes formed at the periphery, and a screw is passed through the penetrating hole to secure the guard frame to the inner top surface of the groove, and the guard frame is capable of supporting the support to secure the lighting element.

According to the above mentioned lamp capable of expanding the illumination range, the reflective cup has a positioning slot formed at an inner edge of the bottom thereof and provided for mounting a lens.

DETAILED DESCRIPTION OF THE PREFERRED EMBODIMENTS

The technical measures used for achieving the expected effect of this disclosure will become clearer in light of the following detailed description of an illustrative embodiment of this disclosure described in connection with the drawings as follows.

Figure 1:
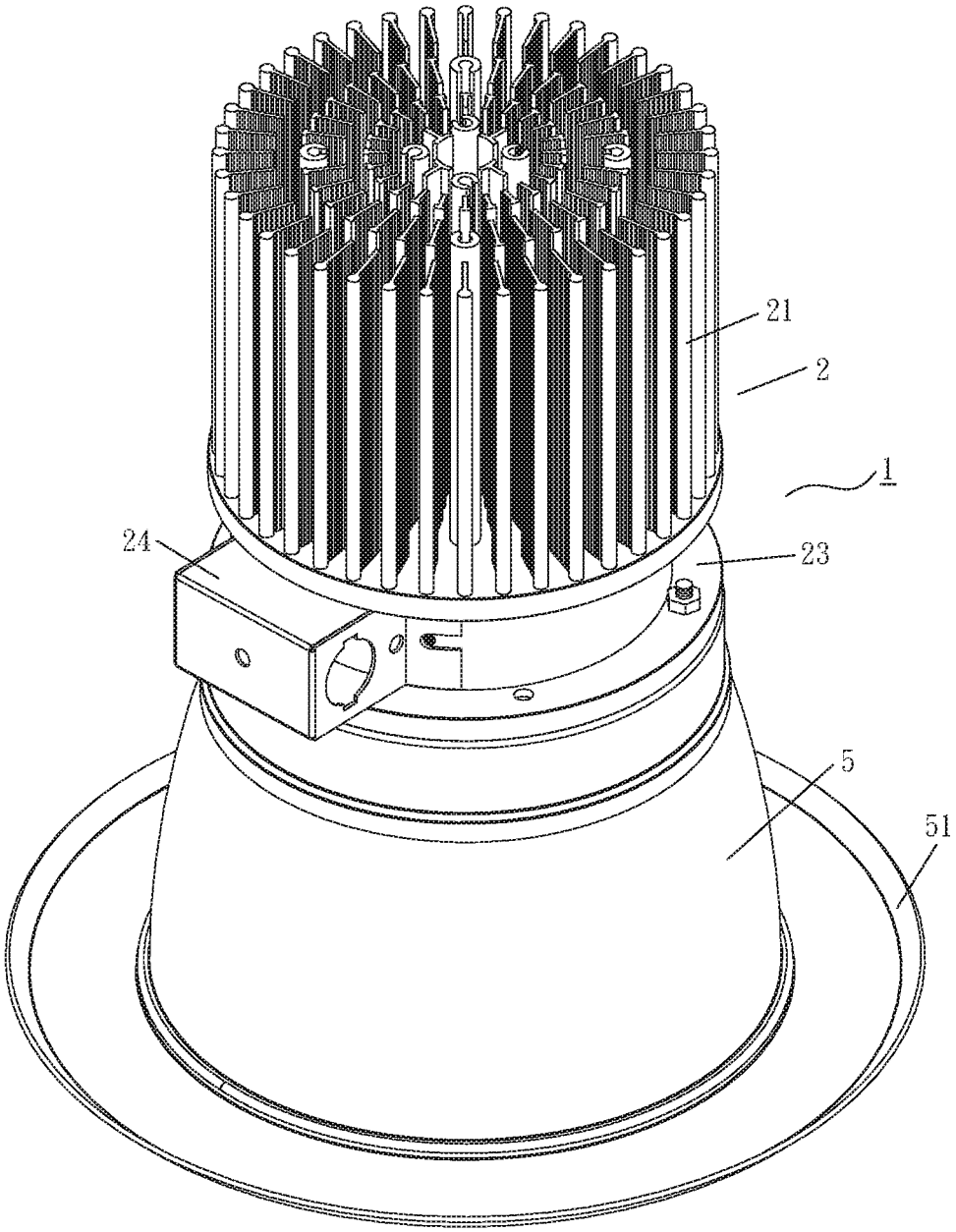
FIG. 1 is a perspective view of an embodiment of this disclosure.
Figure 2:
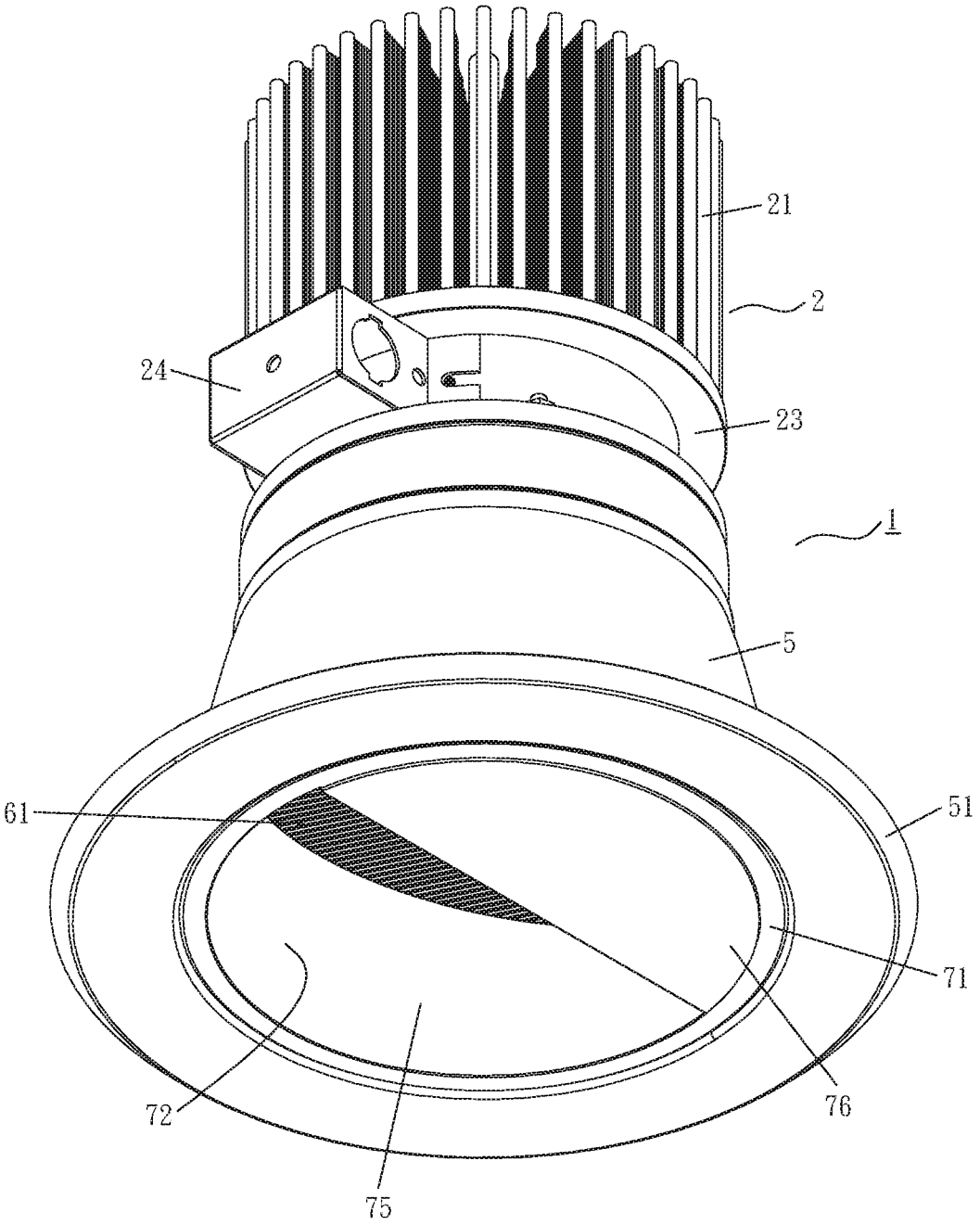
FIG. 2 is another perspective view of an embodiment of this disclosure.
Figure 3:
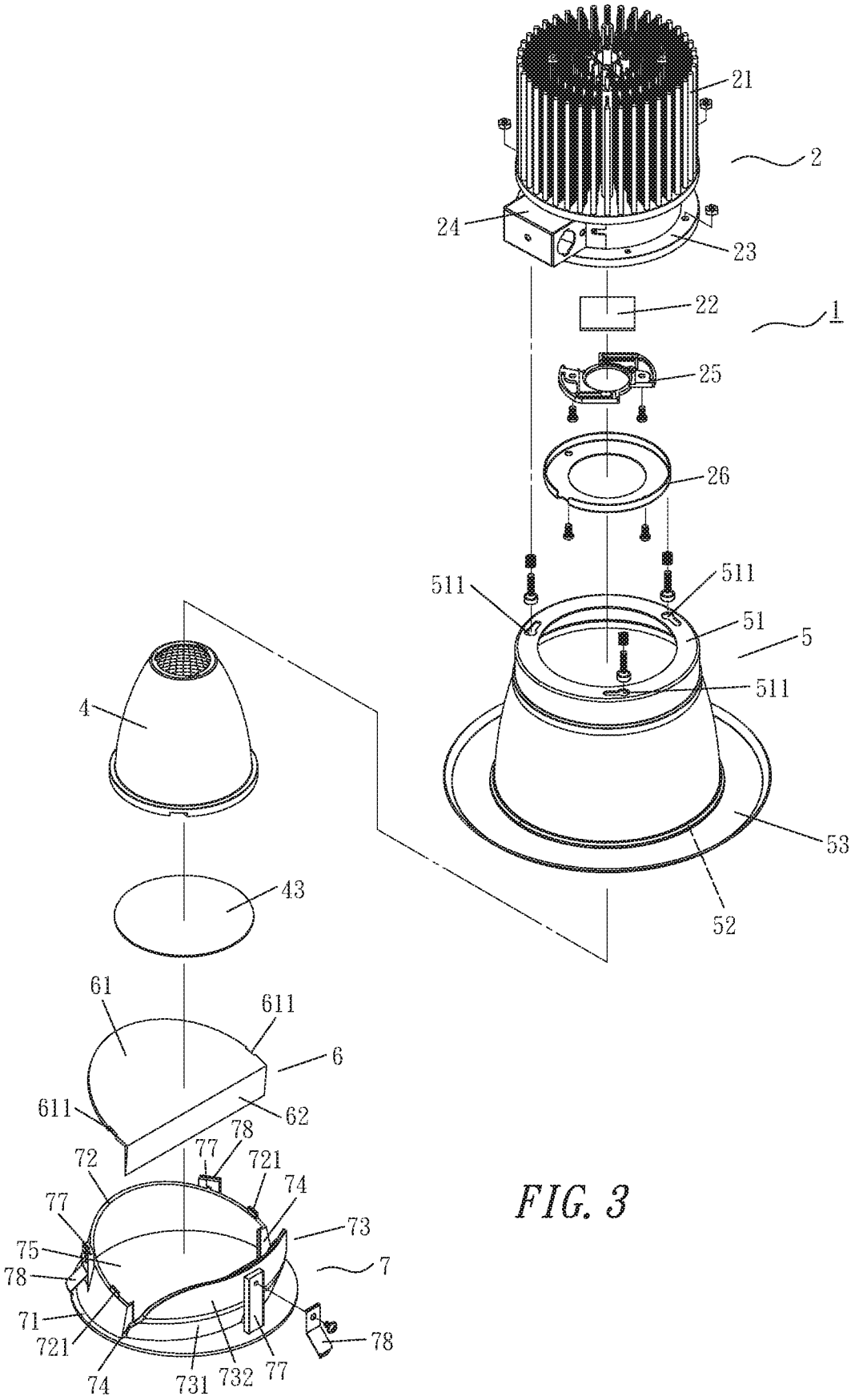
FIG. 3 is an exploded view of an embodiment of this disclosure.
Figure 4:
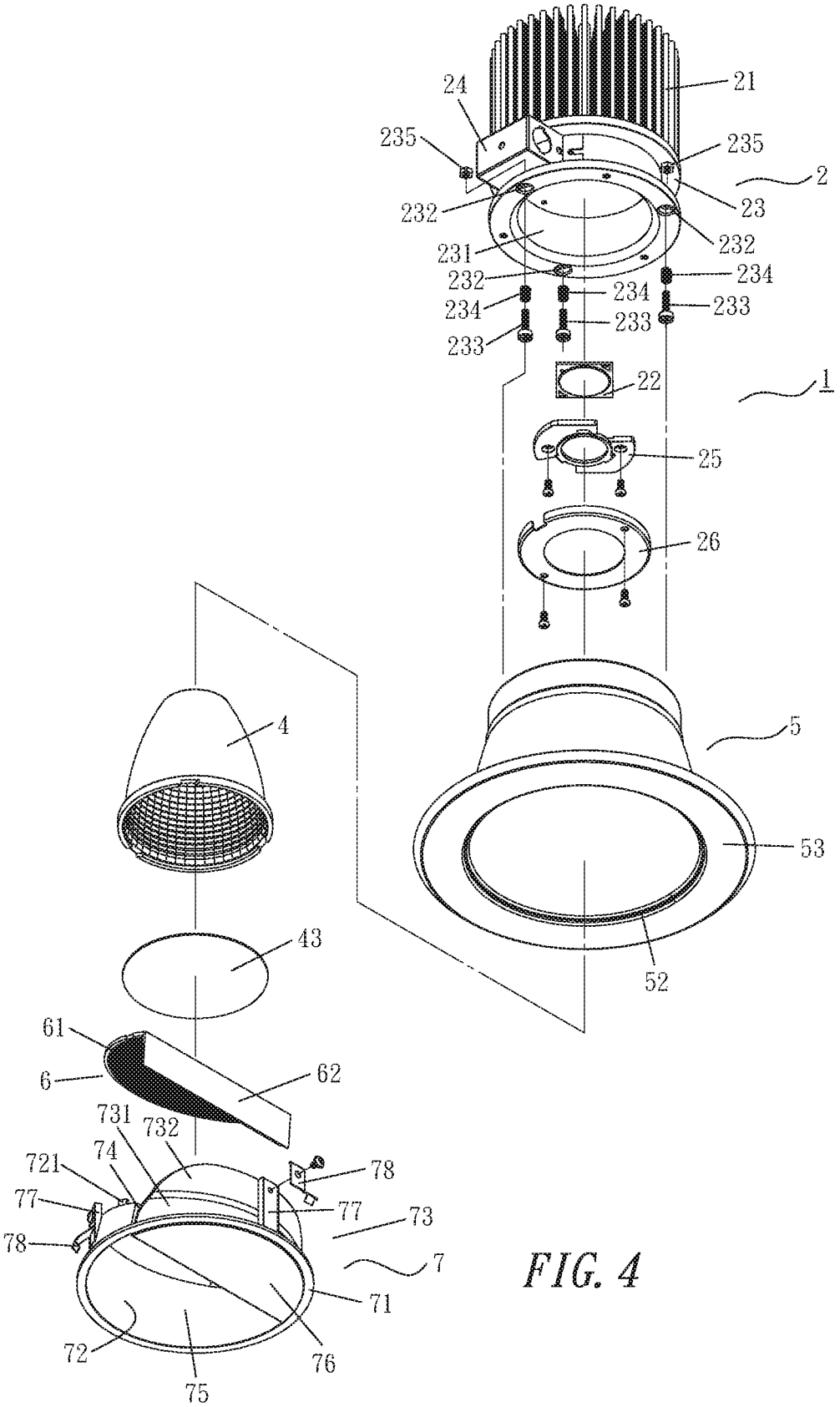
FIG. 4 is another exploded view of an embodiment of this disclosure.
Figure 5:
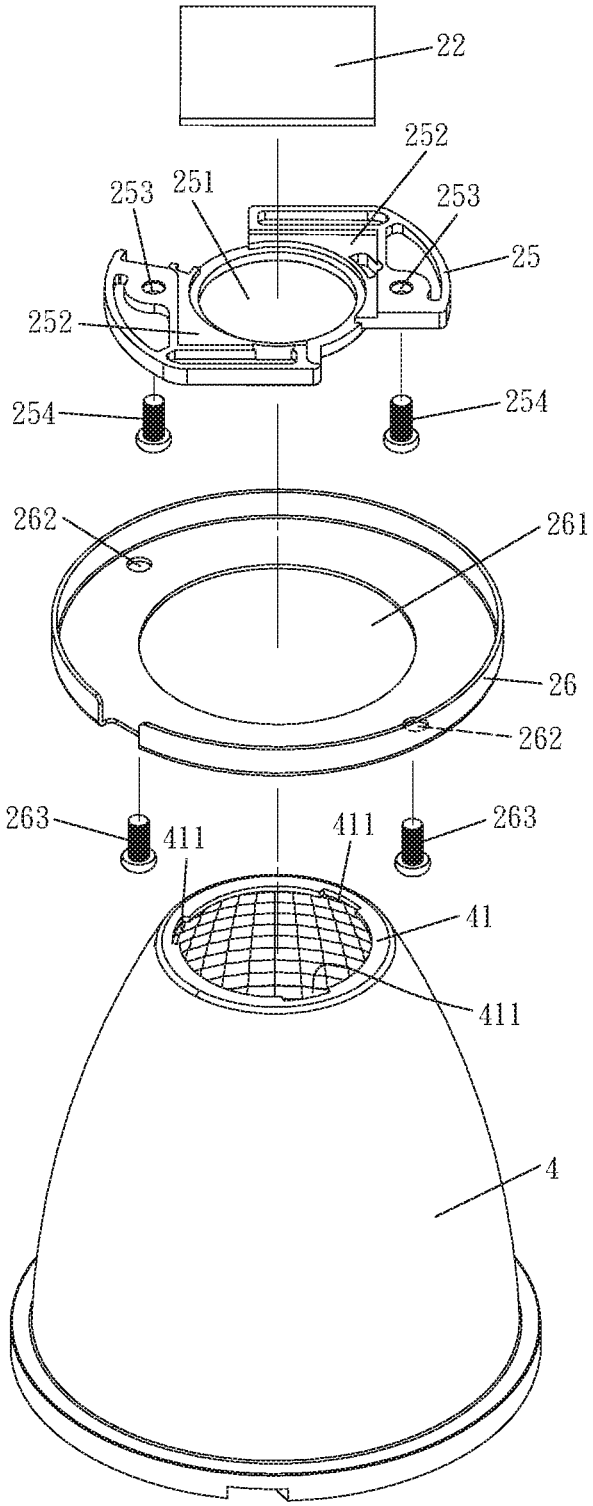
FIG. 5 is an exploded view showing some of the components of an embodiment of this disclosure.
Figure 6:
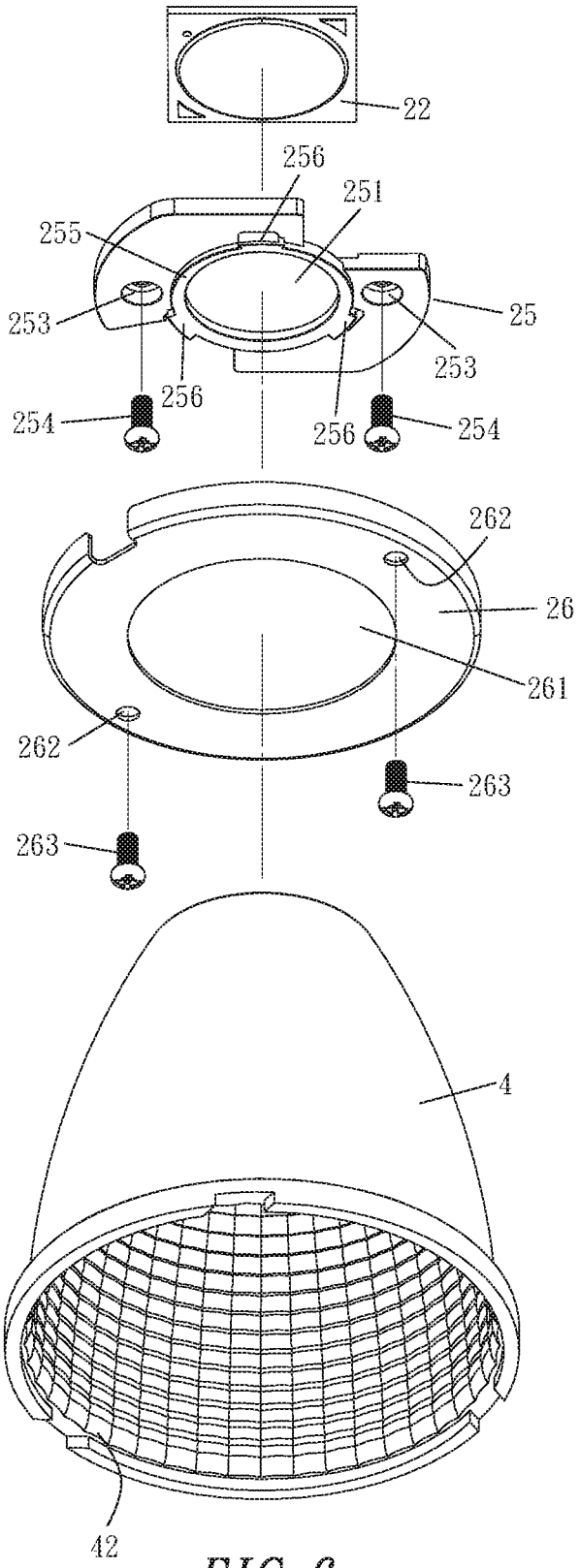
FIG. 6 is another exploded view showing some of the components of an embodiment of this disclosure.
Figure 7:
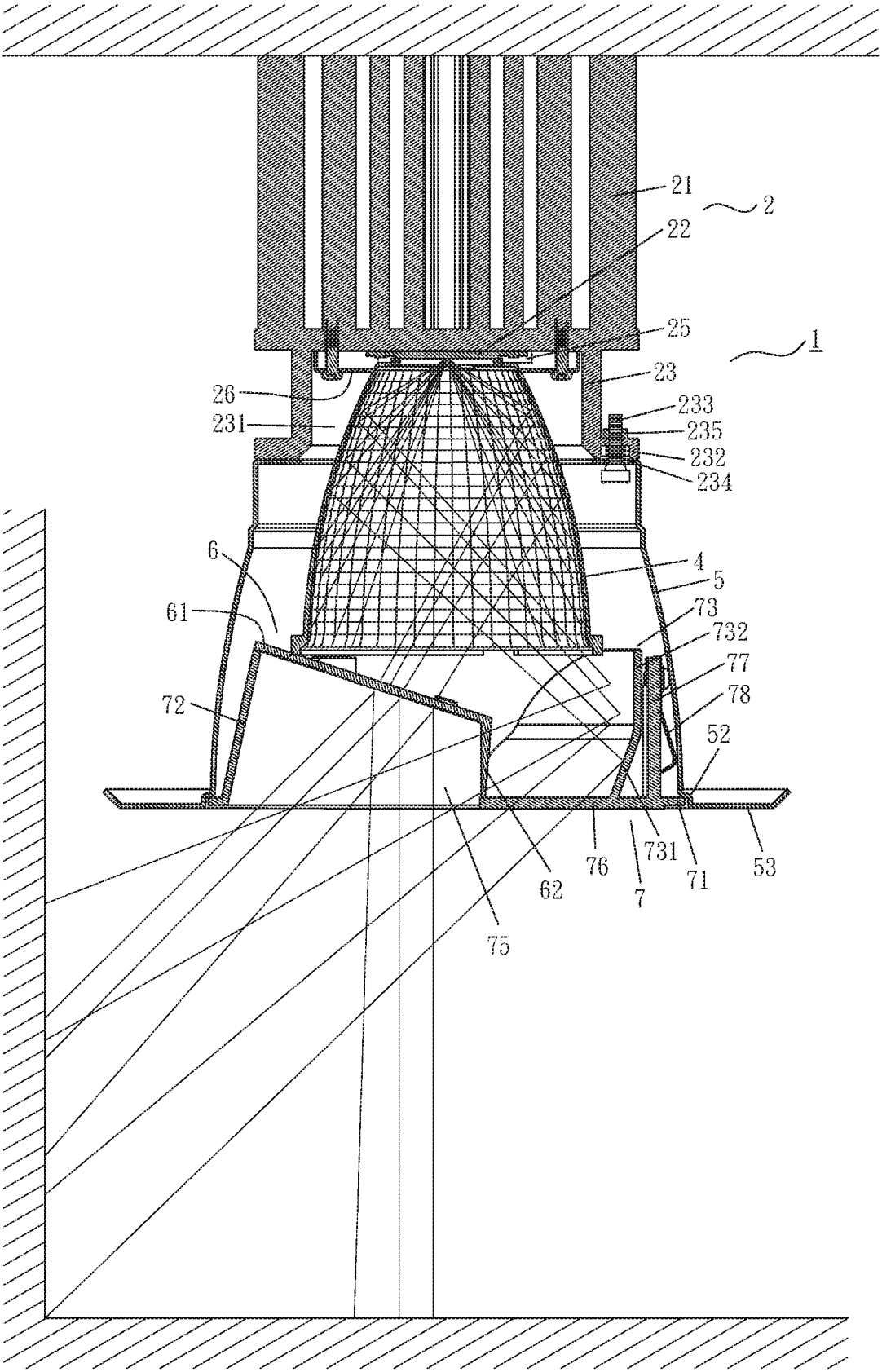
FIG. 7 is a schematic view showing a wall washing effect of the light of an embodiment of this disclosure.

With reference to FIGS. 1 to 4, for a lamp in accordance with an embodiment of this disclosure, the lamp 1 comprises the following elements:

A lighting and cooling module 2 is comprised of a cooling element 21 and a lighting element 22, and a plurality of fins is formed at an upper section of the cooling element 21, and a base 23 is formed at the bottom of the cooling element 21, and a grooved 231 (as shown in FIGS. 4 and 7) is inwardly and concavely formed at the bottom of the base 23, and through slots 232 are formed on the circumferential surface at the bottom of the base 23 and equally divided (there are three equally divided parts as shown in the figure), wherein each through slot 232 is provided for passing a screw 233 from bottom to top first and then sheathing on an elastic member 234, and further passing through the through slot 232, and a nut 235 is screwed, so that the elastic push provided by the elastic member 234 pull the screw 233 which has a tendency to move upward, and the elastic member 234 will stay in the through slot 232 (as shown in FIG. 7), and the exterior of the base 23 will be connected to a temperature controller 24, so that there is an electrical connection between the temperature controller 24 and the lighting element 22, wherein the temperature controller 24 is provided for detecting an ambient temperature and disconnecting the power source when the detected ambient temperature exceeds a set value, so as to avoid an overheat of the lighting element 22. The lighting element 22 is supported by a support 25 and attached onto the inner top surface of the groove 231, so that when the lighting element 22 emits light, the heat so generated will be dissipated to the outside from the fins of the cooling element 21. With reference to FIGS. 5 and 6, the support 25 has a large through hole 251 formed at the center, and a positioning slot 252 formed at the top surface, for accommodating and positioning the lighting element 22, and the light emitted by the lighting element 22 is diffused downwardly from the large through hole 251, and each of both sides of the support 25 has a penetrating hole 253, and a screw 254 is installed into the penetrating hole 253, and the support 25 and the lighting element 22 are secured to the inner top surface of the groove 231 (as shown in FIG. 7), and the bottom surface of the support 25 has a flange 255 with a specific height formed at the periphery of the large through hole 251, and the flange 255 further has a positioning plate 256 outwardly protruding from several parts of a lower edge of the flange 22 (there are three equally divided parts shown in the figure).

A guard frame 26 is a frame wall with a height raised from the outer edge, and the frame has a plane inside, a large through hole 261 formed at the center, and a plurality of penetrating holes 262 formed at the periphery of the guard frame 26, so that a screw 263 can be passed through the penetrating hole 262 to lock and secure the guard frame 26 to the inner top surface of the groove 231 (as shown in FIG. 7), wherein the position where the plane of the guard frame 26 exists is lower than the position of the support 25, so that the support 25 can be supported to secure the lighting element 22;

A reflective cup 4 is in the shape of an arc cover, wherein both of the top and bottom of the reflective cup 4 are hollow, and the top has a micro shield wall 41 extending inwardly, and several parts of the inner edge of the micro shield wall 41 (there are three equally divided parts shown in the figure) further have a positioning slot 411, and the inner diameter enclosed by the inner edge of the micro shield wall 41 is corresponsive to the outer diameter of the flange 255 at the bottom surface of the support 25, and the size and position of the positioning slot 411 at the inner edge of the micro shield wall 41 correspond to those of the positioning plate 256 on the flange 255 at the bottom surface of the support 25. In the meantime, the outer diameter of the top of the reflective cup 4 is smaller than the large through hole 261 of the guard frame 26, so that the top of the reflective cup 4 can pass upwardly through the large through hole 261 of the guard frame 26, and then from the inner edge of the micro shield wall 41 through the flange 255 at the bottom of the support 25, and the positioning slots 411 at the inner edge of the micro shield wall 41 pass through the positioning plate 256 on the flange 255 at the bottom of the support 25 one by one, and then the reflective cup 4 can be rotated by a small angle, so that the micro shield wall 41 next to the positioning slot 411 enters into the space between the bottom of the support 25 and the positioning plate 256 to receive the support. The inner wall of the reflective cup 4 is designed as a polyhedron (having scaly surfaces), for completely refracting the light diffused by the lighting element 22, and a positioning slot 42 is formed at an inner edge of the bottom of the reflective cup 4 for installing a lens 43, so as to ensure that the interior of the reflective cup 4 and the environment of the lighting element 22 can be sutured in a stable condition.

A lampshade 5 is in shape of an cover, and has both top and bottom which are hollow, and the top has a shield wall 51 extending inwardly, and there are several parts on the shield wall 51 (Three equally divided parts are shown in the figure) and each part has a wide-narrow slot 511 concavely formed thereon, and a wide hole and a narrow slot are combined to form the wide-narrow slot 511, wherein the diameter of the wide hole is provided for passing the head of the screw 233, but width of the narrow slot does not allow the head of the screw 233 to pass through. During assembling, the lampshade 5 is turned from the shield wall 51 to approach the base 23, and the wide hole of the wide-narrow slot 511 on the shield wall 51 corresponds to the pushed-in head of a screw 233, so that the wide hole of the wide-narrow slot 511 is sheathed on each screw 233, and then the lampshade 5 is rotated, so that the narrow slot is moved under the head of each screw 233. As a result, the narrow slot of each wide-narrow slot 511 is clamped by the head of the screw 233 and the bottom of the base 23, and the reflective cup 4 is surrounded by the lampshade 5 and drooped from the bottom of the lighting and cooling module 2 (as shown in FIG. 7).

A positioning slot 52 is formed at an inner edge of the bottom of the lampshade 5, and then expanded outwardly into a decorative ring 53 in the shape of a plane.

A diffuser plate 6 is a translucent plate, and its structure is divided into an oblique circular arc plate 61 and a vertical riser 62, and the bottom of the circular arc plate 61 has a plurality of ruled gratings formed by convex and concave embossed marks, and the edge of each of both sides of the circular arc plate 61 has a micro snap slot 611.

A wash wall cup 7 has an outwardly expanded micro shield wall 71 disposed at the bottom thereof, a front arc wall 72 inwardly tilted with a curvature and standing on a side (which is the front side), and the front arc wall 72 is higher than the front end, and descended towards both sides to a specific height (as shown in FIG. 7), and the other side (which is the rear side) has a rear arc wall 73 standing thereon and the rear arc wall 73 is further divided into a rear oblique arc wall 731 at the bottom and a rear vertical arc wall 732 at the top, wherein both sides of the rear vertical arc wall 732 descend with a curvature, and both sides of the rear oblique arc wall 731 continue to descend until they are next to both sides of the front arc wall 72, so as to form an inlay seam 74, and the top surface being a hollow is enclosed and formed by the front arc wall 72 and the rear arc wall 73. When a boundary line is drawn by joining two points between the inlay seam 74 of both sides, the space enclosed by the front arc wall 72 is projected downwardly as an opening 75 (as shown in FIG. 4), and the space enclosed by the rear arc wall 73 is projected downwardly as a shielding wall 76. In other words, the opening 75 and the shielding wall 76 are separated by the boundary line, and the top edge of each of both sides of the front arc wall 72 has a micro snap bump 721, and the height and position of the snap bump 721 are corresponsive to those of the micro snap slot 611 at the edges of both sides of the circular arc plate 61. The wash wall cup 7 has a plurality of engagement columns 77 disposed different places of the periphery of the wash wall cup 7 (there are places shown in the figure), and each engagement column 77 locks the upper part of an elastic plate 78, and the lower section of the elastic plate 78 is bent outwardly and has a specific elasticity.

According to the aforementioned structure, during assembling, the lighting element 22 is supported by the support 25 and attached to an inner top surface of the groove 231 of the base 23, and then the guard frame 26 is secured to the inner top surface of the groove 231 to support the support 25, such that the lighting element 22 can be positioned securely; and then the reflective cup 4 is assembled to the bottom of the support 25. In the meantime, the lampshade 5 is assembled to the bottom of the base 23, and then the circular arc plate 61 of the diffuser plate 6 is mounted onto the top edge of the front arc wall 72 of the wash wall cup 7, and the two micro snap slots 611 clamp the corresponding micro snap bumps 721 respectively, while both side edges of the riser 62 of the diffuser plate 6 are plugged precisely into the inlay seam 74 of the wash wall cup 7. Now, the circular arc plate 61 of the diffuser plate 6 is in an oblique status (as shown in FIG. 7). Finally, as shown in FIG. 7, the wash wall cup 7 is pushed upwardly from the hollow at the bottom of the lampshade 5. During this process, the lower section of the elastic plate 78 at the periphery of the wash wall cup 7 is pressed to retract along the inner wall of the lampshade 5, so that there is a force abutting the inner wall of the lampshade 5. Until the micro shield wall 71 at the bottom of the wash wall cup 7 is pressed to enter into the positioning slot 52 at the inner edge of the bottom of the lampshade 5, the assembling process of the lamp 1 is completed. The lamp 1 is installed at a position a position for use, and there are two common installation modes: 1. The lamp is installed into a mounting hole reserved in the ceiling. 2. A pulling piece is provided to achieve a suspension installation. However, the installation is not just limited to the aforementioned mode only.

During an application as shown in FIG. 7, the light emitted from the lighting element 22 of the lamp 1 spreads out enters into the reflective cup 4 from different directions, so that the light is completely projected onto the inner wall of the reflective cup 4, and then the inner wall of the reflective cup 4 fully refracts the light downwardly to pass through the lens 43. Besides refraction, the reflective cup 4 also increases the brightness of the light, and the reflective cup 4 carries a first-time alternate refractive diffusion of the light. The light downwardly refracted by the reflective cup 4 is mainly projected to the circular arc plate 61 and the rear arc wall 73, wherein after the light projected to the circular arc plate 61 passes through the plurality of ruled gratings, the whole light is diffused. The light projected to the rear arc wall 73 goes through the refraction of the rear oblique arc wall 731 and the rear vertical arc wall 732 of the rear arc wall 73 at different angles to expand the final projection range of the light, and the diffuser plate 6 and the wash wall cup 7 are provided for a second-time alternate refractive diffusion.

In FIG. 7, a side of the bottom of the lamp 1 is built on a vertical wall, so that after the first-time alternate refractive diffusion of the reflective cup 4 and the second-time alternate refractive diffusion of the diffuser plate 6 and the wash wall cup 7, the light emitted downwardly from the lamp 1 is completely refracted and diffused to the vertical wall, so as to achieve a wall washing effect of the light on the vertical wall by installing just one lamp 1.

While the invention has been described by means of specific embodiments, numerous modifications and variations could be made thereto by those skilled in the art without departing from the scope and spirit of the invention set forth in the claims.

What is claimed is:

1. A lamp capable of expanding the illumination range, comprising:

a lighting and cooling module, comprised of a cooling element and a lighting element, and a plurality of fins being formed at an upper section of the cooling element, and a base being formed at the bottom of the cooling element, and a groove being inwardly and concavely formed at the bottom of the base, and the lighting element being supported by a support and attached onto an inner top surface of the groove; and the support having a large through hole formed at the center of the support, and a positioning slot formed at the top of the support for accommodating and positioning the lighting element, and the light emitted from the lighting element being diffused downwardly through the large through hole, and the bottom surface of the support having a flange with a height and formed at the periphery of the large through hole;

a reflective cup, having a top and a bottom, both being hollow, and the top having a micro shield wall extending inwardly, and the micro shield of the reflective cup being supported by the flange at the bottom surface of the support; and the inner wall of the reflective cup is a polyhedron; a lampshade, having a top and a bottom, both being hollow, and the top having a shield wall extending inwardly, and the shield wall of the lampshade connected to the bottom of the base to enclose the reflective cup and extending from the bottom of the lighting and cooling module, and a positioning slot being formed at an inner edge of the bottom of the lampshade;

a diffuser plate, being a translucent plate, and further divided into an oblique circular arc plate and a vertical riser, and the bottom of the circular arc plate having a plurality of ruled grating formed by convex and concave embossed marks, and each of the edges on both sides of the circular arc plate having a micro snap slot; and a wash wall cup, having an outwardly expanded micro shield wall disposed at the bottom thereof, a front arc wall standing upwardly and laterally with an inwardly tilted curve, and a rear arc wall standing on the other side and being further divided into a rear oblique arc wall disposed at the bottom of the rear arc wall and a rear vertical arc wall disposed at the top of the rear arc wall, and both sides of the rear vertical arc wall dropping with a curvature and both sides of the rear oblique arc wall continuing to drop until their position being next to both sides of the front arc wall, so as to form an inlay seam; a space enclosed by the front arc wall having an opening facing downward, and a space enclosed by the rear arc wall having a shielding wall facing downward, and each top edge on both sides of the front arc wall having a micro snap bump, and the height and position of the snap bump corresponding to those of the micro snap slot formed on both sides of edges of the circular arc plate; the wash wall cup having a plurality of engagement columns formed at several positions of the periphery, and each locking the upper part of an elastic plate, and the lower section of the elastic plate bending outwardly and having an elasticity; the circular arc plate of the diffuser plate being installed at the top edge of the front arc wall, and two micro snap slots clamping the corresponding micro snap bumps respectively, and both side edges of the riser of the diffuser plate being plugged into the inlay seam, and then the wash wall cup being pushed upwardly from the bottom of the lampshade, and then the lower section of the elastic plate at the periphery of the wash wall cup being pressed to retract along the inner wall of the lampshade to abut the inner wall of the lampshade until the micro shield wall at the bottom of the wash wall cup is pressed into the positioning slot at the inner edge of the bottom of the lampshade bottom inner edge.

2. The lamp capable of expanding the illumination range according to claim 1, wherein each of both sides of the support has a penetrating hole, so that a screw can be passed through the penetrating hole, and the support and the lighting element are secured to the inner top surface of the groove.

3. The lamp capable of expanding the illumination range according to claim 1, wherein the support has a plurality of positioning plates protruding outwardly from the lower edge of the flange lower, and the micro shield wall of the reflective cup has a plurality of positioning slots formed thereon, so that when the micro shield wall passes through the flange of the support, the positioning slot of the micro shield wall also passes through the positioning plate of the support, and then the reflective cup is rotated to an angle, so that the micro shield wall next to the positioning slot will be supported when entering into a position between the bottom surface of the support and the positioning plate.

4. The lamp capable of expanding the illumination range according to claim 1, wherein the base bottom surface has a plurality of through slots formed on a circumferential surface thereof, and each through slot is provided for passing a screw from bottom to top through an elastic member, and then passing through the through slot, and a nut is screwed to the top thereof; several parts of the shield wall of the lampshade have a wide-narrow slot, and when the shield wall of the lampshade approaches the base, a wide hole of the wide-narrow slot of the shield wall is plugged with a head of the screw, and the lampshade is rotated to move a narrow slot of the wide-narrow slot to the head of each screw, such that the narrow slot of the wide-narrow slot is clamped by the head of the screw and the bottom of the base.

5. The lamp capable of expanding the illumination range according to claim 1, wherein the inner top surface of the groove is securable with a guard frame, which is a frame wall with a height, whose interior is a plane, and has a large through hole formed at the center, and a plurality of penetrating holes formed at the periphery, and a screw is passed through the penetrating hole to secure the guard frame to the inner top surface of the groove, and the guard frame is capable of supporting the support to secure the lighting element.

6. The lamp capable of expanding the illumination range according to claim 1, wherein the reflective cup has a positioning slot formed at an inner edge of the bottom thereof and provided for mounting a lens.

* * * * *